US011429131B2

(12) United States Patent
Nakatani

(10) Patent No.: US 11,429,131 B2
(45) Date of Patent: Aug. 30, 2022

(54) CONSTANT CURRENT CIRCUIT AND SEMICONDUCTOR APPARATUS

(71) Applicant: Winbond Electronics Corp., Taichung (TW)

(72) Inventor: Masafumi Nakatani, Kanagawa (JP)

(73) Assignee: Winbond Electronics Corp., Taichung (TW)

( * ) Notice: Subject to any disclaimer, the term of this patent is extended or adjusted under 35 U.S.C. 154(b) by 68 days.

(21) Appl. No.: 17/092,338

(22) Filed: Nov. 9, 2020

(65) Prior Publication Data

US 2021/0211044 A1 Jul. 8, 2021

(30) Foreign Application Priority Data

Jan. 7, 2020 (JP) ..... JP2020-000622

(51) Int. Cl.
*G05F 3/24* (2006.01)
*G05F 3/30* (2006.01)
(Continued)

(52) U.S. Cl.
CPC ..... *G05F 3/30* (2013.01); *G05F 1/56* (2013.01); *G05F 3/24* (2013.01); *G05F 3/26* (2013.01); *G05F 3/262* (2013.01)

(58) Field of Classification Search
CPC ... G05F 3/26; G05F 3/262; G05F 3/30; G05F 3/24; G05F 1/56; G05F 1/561; H02M 1/32; H02M 1/327; H02M 3/155
See application file for complete search history.

(56) References Cited

U.S. PATENT DOCUMENTS 6,087,820 A * 7/2000 Houghton ..... G05F 3/262 323/907
7,495,505 B2 2/2009 Chang et al.
(Continued)

FOREIGN PATENT DOCUMENTS

CN 1271116 10/2000
CN 101060008 10/2007
(Continued)

OTHER PUBLICATIONS

"Office Action of Taiwan Counterpart Application", dated Jul. 2, 2021, p. 1-p. 9.
(Continued)

*Primary Examiner* — Thienvu V Tran
*Assistant Examiner* — Shahzeb K Ahmad
(74) *Attorney, Agent, or Firm* — JCIPRNET

(57) ABSTRACT

Provided is a constant current circuit supplying a temperature-compensated constant current. The constant current circuit includes a BGR circuit, a temperature dependent current generator, a reference current generator, and an output current generator. The BGR circuit generates a reference voltage with low voltage dependence. The temperature dependent current generator generates a temperature dependent current having a positive temperature coefficient. The reference current generator generates a temperature-compensated reference current by using the reference voltage and the temperature dependent current. The output current generator generates an output current based on the reference current generated by the reference current generator.

11 Claims, 3 Drawing Sheets

(51) Int. Cl.

| | |
|---|---|
| *G05F 3/26* | (2006.01) |
| *G05F 1/56* | (2006.01) |

(56) References Cited

U.S. PATENT DOCUMENTS

| | | | | |
|---|---|---|---|---|
| 10,429,879 | B1 * | 10/2019 | Coimbra | G05F 3/30 |
| 2019/0199330 | A1 * | 6/2019 | Roy | H03K 3/011 |

FOREIGN PATENT DOCUMENTS

| | | |
|---|---|---|
| JP | 2005234890 | 9/2005 |
| JP | 2006277360 | 10/2006 |
| JP | 2013097751 | 5/2013 |
| JP | 2017526077 | 9/2017 |
| KR | 20000071425 | 11/2000 |
| TW | 201011494 | 3/2010 |
| TW | 201013362 | 4/2010 |
| TW | 201104381 | 2/2011 |
| TW | 201209541 | 3/2012 |
| TW | 201303548 | 1/2013 |
| TW | I499888 | 9/2015 |
| TW | 201539171 | 10/2015 |
| TW | 201612671 | 4/2016 |
| TW | 201804278 | 2/2018 |
| WO | 2017015850 | 2/2017 |

OTHER PUBLICATIONS

Office Action of Korea Counterpart Application, with English translation thereof, dated Nov. 19, 2021, pp. 1-11.

"Office Action of China Counterpart Application", dated Mar. 1, 2022, p.1-p. 7.

* cited by examiner

CONSTANT CURRENT CIRCUIT AND SEMICONDUCTOR APPARATUS

CROSS-REFERENCE TO RELATED APPLICATION

This application claims the priority benefit of Japan application serial no. 2020-000622, filed on Jan. 7, 2020. The entirety of the above-mentioned patent application is hereby incorporated by reference herein and made a part of this specification.

BACKGROUND

Technical Field

The disclosure relates to a constant current circuit that supplies a constant current, and particularly to a constant current circuit that can be used as a constant current source for a semiconductor apparatus or the like.

Description of Related Art

There has been conventionally known a current mirror circuit for use in a constant current circuit, and such a constant current circuit is disclosed in, for example, Japanese Patent Laid-Open No. 2005-234890. In addition, a constant current circuit that outputs a constant current without being dependent on power supply voltage is disclosed in, for example, Japanese Patent Laid-Open No. 2013-97751.

FIG. 1 shows a configuration of a conventional constant current circuit. As shown in the figure, a constant current circuit 10 includes an operational amplifier OP, a P-channel metal oxide semiconductor (PMOS) transistor Q1, a PMOS transistor Q2, and a variable resistor $R_T$. A reference voltage $V_{REF}$ is input to a non-inverting input terminal (+) of the operational amplifier OP. A voltage $V_N$ of a note N is input to an inverting input terminal (−) through negative feedback. The PMOS transistor Q1 and the variable resistor $R_T$ are connected in series between a power supply voltage VDD and ground (GND), and a gate of the PMOS transistor Q1 is connected to an output of the operational amplifier OP. A resistance value of the variable resistor $R_T$ is trimmed in response to a deviation of a circuit element or the like. In addition, a gate of the PMOS transistor Q2 is connected to the output of the operational amplifier OP so as to constitute a current mirror circuit with the PMOS transistor Q1. The operational amplifier OP controls a gate voltage of the PMOS transistor Q1 so that the voltage $V_N$ of the node N becomes equal to the reference voltage $V_{REF}$ ($V_N=V_{REF}$). That is, the operational amplifier OP functions as a unity gain buffer. As a result, a reference current flowing through the PMOS transistor Q1 is represented by $I_{REF}=V_{REF}/R_T$, and the reference current $I_{REF}$ becomes a constant current that does not depend on power supply voltage variations. In addition, the PMOS transistor Q2 generates an output current $I_{MIRROR}$ corresponding to the reference current $I_{REF}$ flowing through the PMOS transistor Q1, and the output current $I_{MIRROR}$ is supplied to a load.

In design of an analog circuit, the temperature dependence of a constant current circuit or a constant current source may often become a problem. For example, an oscillator may include a delay circuit in order to determine a cycle time (period) of oscillation. In some cases, a constant current circuit may be used for the delay circuit in order to avoid the voltage dependence of delay time caused by power supply voltage variations or the like. However, if a constant current supplied from the constant current circuit is temperature dependent, the delay circuit may vary in delay time with respect to temperature, and the cycle time of the oscillator may vary with the temperature. For example, in the case of the constant current circuit 10 as shown in FIG. 1, since the variable resistor $R_T$ is composed of a conductive polysilicon layer doped with impurities at a high concentration, an N+ diffusion region, or metal or the like, the resistance value has a positive temperature coefficient (i.e., the resistance value increases as the temperature rises, and decreases as the temperature falls). Therefore, the reference current $I_{REF}$ has a negative temperature coefficient, the copied output current $I_{MIRROR}$ also has a negative temperature coefficient, and the current supplied to the load may change according to the temperature.

SUMMARY

The disclosure provides a constant current circuit supplying a temperature-compensated constant current.

A constant current circuit according to the disclosure includes: a reference voltage generator, generating a reference voltage; a reference current generator, generating a reference current that does not depend on a power supply voltage; and a temperature dependent current generator, generating a temperature dependent current having a positive temperature coefficient. The reference current generator includes a first circuit generating a reference current having a negative temperature coefficient based on the reference voltage and a second circuit generating a reference current having a positive temperature coefficient based on the temperature dependent current. The reference current generator generates the reference current by adding up the reference current having the negative temperature coefficient and the reference current having the positive temperature coefficient.

In one embodiment of the constant current circuit of the disclosure, the first circuit includes a unity gain buffer operating so as to generate the reference voltage at an output node and a resistor connected to a first path between the output node and ground. The reference current having the negative temperature coefficient is generated in the first path. The second circuit includes a second path connected in parallel with the first path. The reference current having the positive temperature coefficient is generated in the second path. The reference current is generated by adding up the reference current having the negative temperature coefficient and flowing through the first path and the reference current having the positive temperature coefficient and flowing through the second path. In one embodiment of the constant current circuit of the disclosure, the unity gain buffer is an operational amplifier including an inverting input terminal to which the reference voltage is input and a non-inverting input terminal in which the output node is short-circuited. The second circuit includes a first transistor of N-channel metal oxide semiconductor (NMOS) type generating the reference current having the positive temperature coefficient in the second path. In one embodiment of the constant current circuit of the disclosure, the first circuit includes a first adjustment circuit adjusting a magnitude of the reference current having the negative temperature coefficient. In one embodiment of the constant current circuit of the disclosure, the first adjustment circuit adjusts a resistance value of the resistor on the first path. In one embodiment of the constant current circuit of the disclosure, the second circuit includes a second adjustment circuit adjusting a magnitude of the reference current having the positive temperature coefficient. In one embodiment of the constant current circuit of the disclosure, the second adjustment circuit adjusts a drain current flowing through the first transistor. In one embodiment of the constant current circuit of the disclosure, the temperature dependent current generator includes a second transistor of NMOS type through which the temperature dependent current flows. The first transistor and the second transistor constitute a current mirror circuit. In one embodiment of the constant current circuit of the disclosure, the second adjustment circuit adjusts a mirror ratio of the current mirror circuit. In one embodiment of the constant current circuit of the disclosure, the first adjustment circuit and the second adjustment circuit adjust the reference current having the negative temperature coefficient and the reference current having the positive temperature coefficient so that a temperature coefficient of the reference current becomes zero. In one embodiment of the constant current circuit of the disclosure, the first adjustment circuit and the second adjustment circuit adjust the reference current having the negative temperature coefficient and the reference current having the positive temperature coefficient so that a temperature coefficient of the reference current becomes positive or negative. In one embodiment of the constant current circuit of the disclosure, the reference voltage generator includes a bandgap reference circuit. The temperature dependent current generator is connected to the bandgap reference circuit. The temperature dependent current generator generates the temperature dependent current based on a bandgap reference current for generating the reference voltage in the bandgap reference circuit. In one embodiment of the constant current circuit of the disclosure, the bandgap reference circuit includes a third transistor of P-channel metal oxide semiconductor (PMOS) type generating the bandgap reference current. The temperature dependent current generator includes a fourth transistor of PMOS type constituting a current mirror circuit with the third transistor.

According to the disclosure, the reference current generator generating the reference current that does not depend on the power supply voltage generates the reference current by adding up the reference current having the negative temperature coefficient and the reference current having the positive temperature coefficient. Therefore, a temperature-compensated reference current can be generated.

DESCRIPTION OF THE EMBODIMENTS

Next, the embodiments of the disclosure will be described in detail with reference to the drawings. A constant current circuit of the disclosure may be used in a storage apparatus such as a flash memory, a dynamic memory (e.g., dynamic random access memory (DRAM)), a static memory (e.g., static random access memory (SRAM)), a resistance-change memory (e.g., resistive random access memory (RRAM)), or a magnetic memory (e.g., magnetic random access memory (MRAM)), or a semiconductor apparatus for logic circuits, signal processing or the like.

EMBODIMENTS

Figure 2:
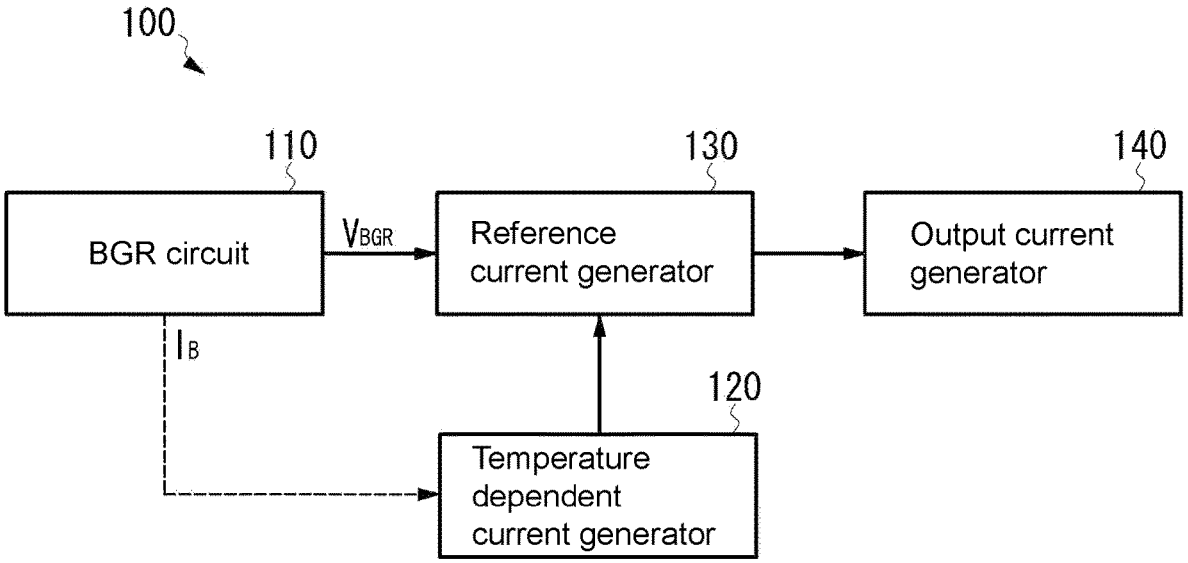
FIG. 2 is a block diagram showing a configuration of a constant current circuit according to an embodiment of the disclosure.
Figure 3:
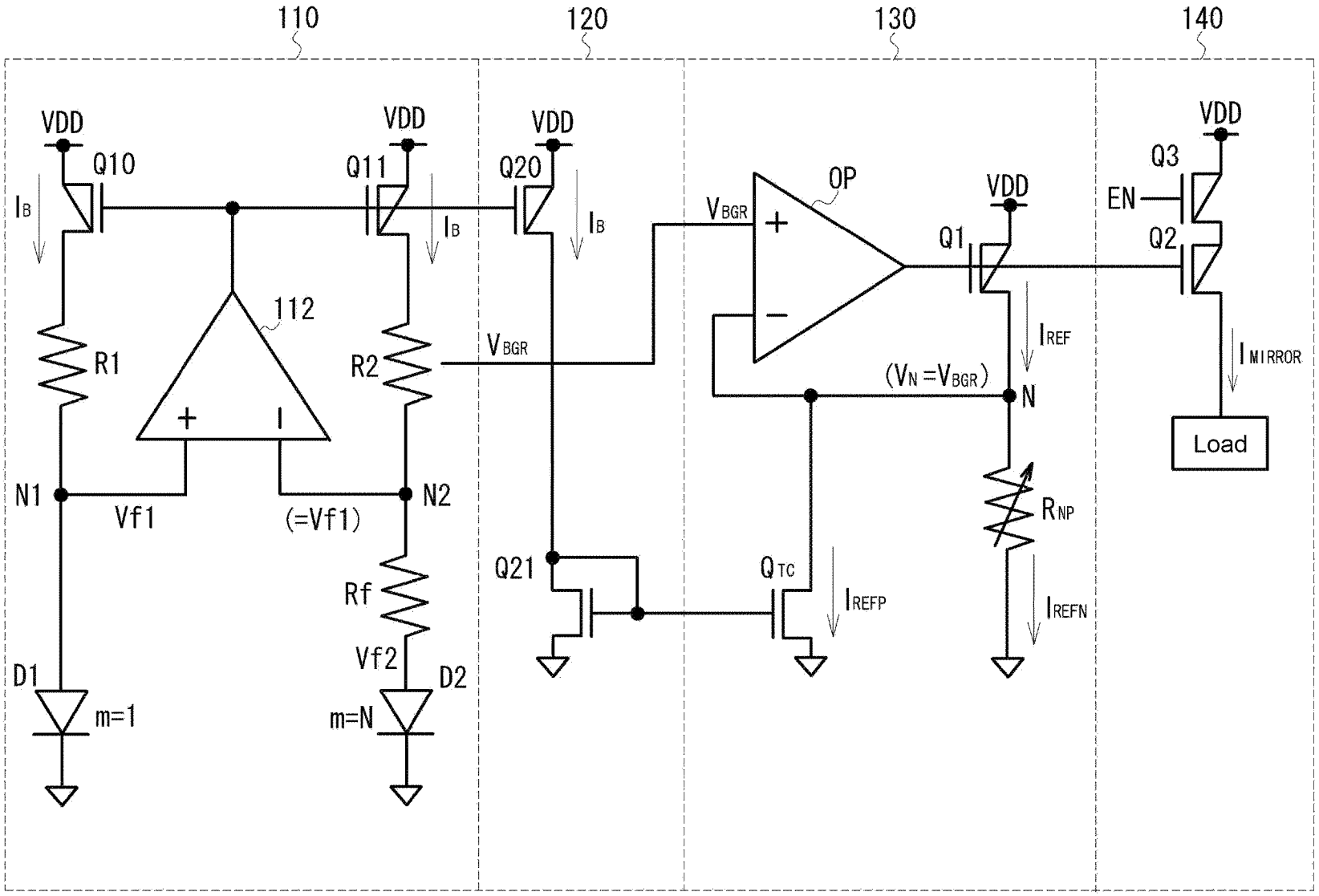
FIG. 3 shows a configuration of a constant current circuit according to an embodiment of the disclosure.

Next, a constant current circuit according to an embodiment of the disclosure will be described with reference to the drawings. FIG. 2 is a block diagram showing a configuration of a constant current circuit according to the present embodiment. FIG. 3 shows a circuit configuration of a constant current circuit. A constant current circuit 100 of the present embodiment includes a bandgap reference circuit (hereinafter "BGR circuit") 110, a temperature dependent current generator 120, a reference current generator 130, and an output current generator 140. The BGR circuit 110 generates a reference voltage $V_{BGR}$ with low dependence on power supply voltage variations or temperature changes. The temperature dependent current generator 120 generates a temperature dependent current having a positive temperature coefficient. The reference current generator 130 generates a temperature-compensated reference current (or constant current) $I_{REF}$ by using the reference voltage $V_{BGR}$ and the temperature dependent current. The output current generator 140 generates an output current based on the reference current $I_{REF}$ generated by the reference current generator 130.

By using a bandgap voltage as a physical property of silicon as a semiconductor material, the BGR circuit 110 generates a reference voltage $V_{BGR}$ that is stable and has low dependence on variations in temperature or power supply voltage. As shown in FIG. 3, the BGR circuit 110 includes a first current path and a second current path between a power supply voltage VDD and ground GND. The first current path includes a PMOS transistor Q10, a resistor R1 and a diode D1 connected in series. The second current path includes a PMOS transistor Q11 (whose configuration is the same as that of the PMOS transistor Q10), a resistor R2 (whose resistance value is the same as that of the resistor R1), a resistor Rf and a diode D2 connected in series. The BGR circuit 110 further includes an operational amplifier 112. In the operational amplifier 112, a non-inverting input terminal (+) is connected to a node N1 connecting the resistor R1 and the diode D1, an inverting input terminal (−) is connected to a node N2 connecting the resistor R2 and the resistor Rf, and an output terminal is commonly connected to gates of the PMOS transistors Q10 and Q11.

An area ratio of the diode D1 to the diode D2, or a ratio of the number of parallel-connected diodes D1 to the number of parallel-connected diodes D2, is 1 to N (N is a number greater than 1). A current density of the diode D1 is N times that of the diode D2. Herein, the diodes D1 and D2 are described as examples, and a bipolar transistor to which a diode is connected may be used instead of the diodes D1 and D2.

The operational amplifier 112 controls a gate voltage of the PMOS transistors Q10 and Q11 so that a voltage Vf1 at the node N1 and a voltage at the node N2 become equal to each other. Thus, a current $I_B$ flows through the first current path via the PMOS transistor Q10, and the same current $I_B$ as that flowing through the first current path flows through the second current path via the PMOS transistor Q11.

Although the same current $I_B$ flows through the diode D1 and the diode D2, since the area ratio of the diode D1 to the diode D2 is 1 to N, the following equation (1) holds.

$$Vf1 - Vf2 = \frac{kT}{q}\ln N \quad (1)$$

Vf1 represents a terminal voltage (voltage at the node N1) of the diode D1, Vf2 represents a terminal voltage of the diode D2, k represents the Boltzmann constant, T represents absolute temperature, and q represents a charge of an electron.

In addition, the current $I_B$ flowing into the resistor Rf is represented by the following equation (2).

$$I_B = \frac{Vf1 - Vf2}{Rf} = \frac{T}{Rf} \times \frac{k}{q}\ln N \quad (2)$$

A temperature dependent factor is T/Rf. Generally, the current $I_B$ has a positive temperature coefficient.

The reference voltage $V_{BGR}$ may be generated from the second current path. In the example of FIG. 3, the reference voltage $V_{BGR}$ is generated from a resistor R2' at a selected tap position of the resistor R2, and is represented by the following equation (3).

$$V_{BGR} = Vf1 + I_B R2' \quad (3)$$

Figure 1:
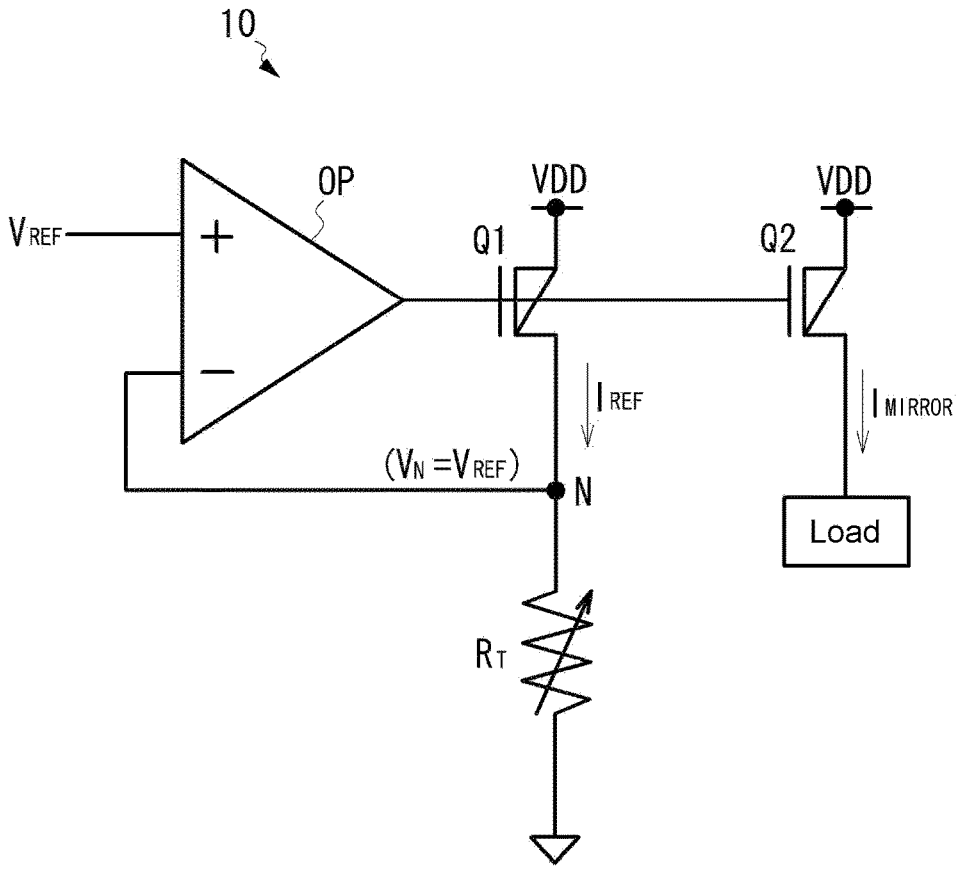
FIG.1(Related Art)
FIG. 1 shows a configuration of a conventional constant current circuit.

The reference voltage $V_{BGR}$ generated by the BGR circuit 110 is a voltage with low voltage dependence and temperature dependence. As shown in FIG. 3, the reference voltage $V_{BGR}$ is input to a non-inverting input terminal (+) of an operational amplifier OP of the reference current generator 130. The reference current generator 130 includes the operational amplifier OP, a PMOS transistor Q1, a variable resistor $R_{NP}$, and an NMOS transistor $Q_{TC}$. The operational amplifier OP, the PMOS transistor Q1, and the variable resistor $R_{NP}$ function in the same way as their counterparts in the constant current circuit 10 shown in FIG. 1. That is, the operational amplifier OP controls operation of the PMOS transistor Q1 so that the voltage $V_N$ at the node N becomes equal to the reference voltage $V_{BGR}$. The reference current $I_{REF}$ flowing through the PMOS transistor Q1 is represented as $I_{REF}=V_{BGR}/R_{NP}$, and is a constant current that does not depend on power supply voltage variations.

The node N performs negative feedback on an inverting input terminal (−) of the operational amplifier OP, and two current paths are connected in parallel at the node N. One of the current paths includes the resistor $R_{NP}$ between the node N and the ground GND and generates a reference current $I_{REFN}$ having a negative temperature coefficient, and the other current path includes the NMOS transistor $Q_{TC}$ between the node N and the ground GND and generates a reference current $I_{REFP}$ having a positive temperature coefficient. That is, the reference current $I_{REF}$ becomes a current obtained by adding up the reference current $I_{REFN}$ having the negative temperature coefficient and the reference current $I_{REFP}$ having the positive temperature coefficient respectively flowing through the two current paths connected to the node N.

Figure 4A:
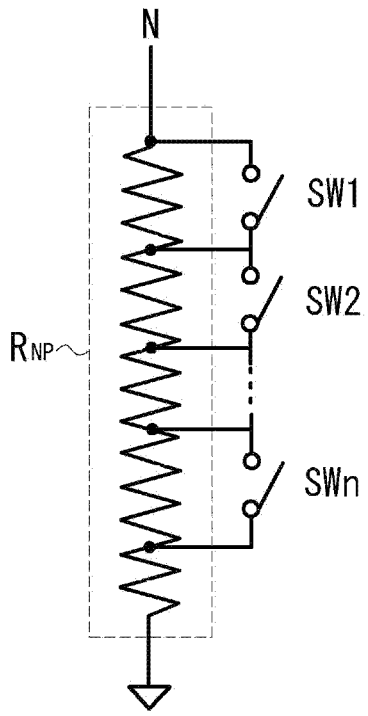
FIG. 4A shows an example of trimming a resistor.

The resistor $R_{NP}$ includes, for example, a conductive polysilicon layer doped with impurities at a high concentration, an N+ diffusion region, or metal or the like, and has a positive temperature coefficient. Therefore, the reference current $I_{REFN}$ flowing through the resistor $R_{NP}$ has a negative temperature coefficient. The resistance value of the resistor $R_{NP}$ can be adjusted by trimming, thereby adjusting a magnitude (current value) of the reference current $I_{REFN}$ flowing through the resistor $R_{NP}$ and having the negative temperature coefficient. A method for trimming the resistor $R_{NP}$ is arbitrary. For example, as shown in FIG. 4A, a switch SW1 and switches SW2 to SWn are respectively connected between multiple taps of the resistor $R_{NP}$. By switching on the selected switches SW1 to SWn, a part of the resistor $R_{NP}$ is short-circuited, thereby adjusting the resistance value. Each of the switches SW1 to SWn can be controlled by, for example, a controller of a semiconductor apparatus equipped with a constant current circuit.

The NMOS transistor $Q_{TC}$ generates the reference current $I_{REFP}$ having the positive temperature coefficient based on the temperature dependent current generated by the temperature dependent current generator 120. For example, as shown in FIG. 3, the NMOS transistor $Q_{TC}$ and an NMOS transistor Q21 of the temperature dependent current generator 120 constitute a current mirror circuit. The reference current $I_{REFP}$ having the positive temperature coefficient is generated from the temperature dependent current $I_B$ flowing through the NMOS transistor Q21 and having the positive temperature coefficient.

The temperature dependent current generator 120 generates the temperature dependent current having the positive temperature coefficient and supplies the temperature dependent current to the reference current generator 130. The temperature dependent current generator 120 may generate the temperature dependent current by its own circuit, or may generate the temperature dependent current by using the current $I_B$ for generating the reference voltage $V_{BGR}$ in the BGR circuit 110, as shown in FIG. 3. In the example of FIG. 3, the temperature dependent current generator 120 includes a current path between the power supply voltage VDD and the ground GND, and this current path includes a PMOS transistor Q20 and the NMOS transistor Q21 connected in series. The PMOS transistor Q20 has the same configuration as that of the PMOS transistors Q10 and Q11. A gate of the PMOS transistor Q20 is connected to an output of the operational amplifier 112. The PMOS transistor Q20 constitutes a current mirror circuit together with the PMOS transistors Q10 and Q11. Thus, the current $I_B$ is generated in the current path via the PMOS transistor Q20.

In addition, a gate of the NMOS transistor Q21 is connected to a drain of the NMOS transistor Q21, and is connected to a gate of the NMOS transistor $Q_{TC}$. The NMOS transistor Q21 and the NMOS transistor $Q_{TC}$ constitute a current mirror circuit. When the current $I_B$ flows through the PMOS transistor Q20, the NMOS transistor Q21 is turned on, and the reference current $I_{REFP}$ having the positive temperature coefficient corresponding to a current mirror ratio also flows in the NMOS transistor $Q_{TC}$. As shown in the equation (2), since the current $I_B$ has a positive temperature coefficient, the reference current $I_{REFP}$ also has a positive temperature coefficient.

Figure 4B:
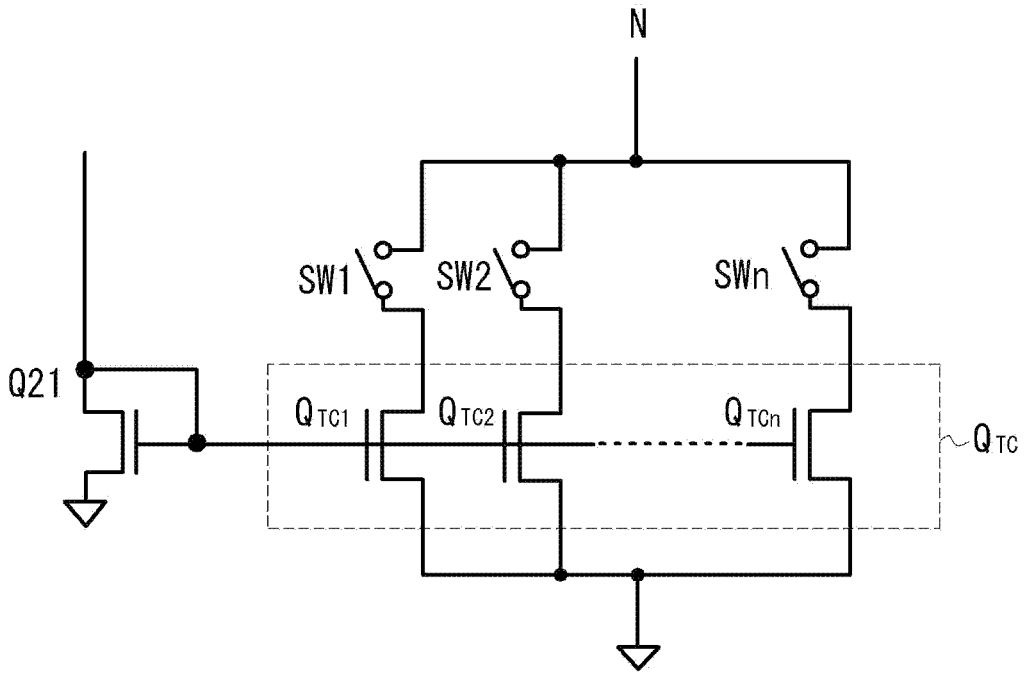
FIG. 4B shows an example of trimming a current mirror ratio.

The magnitude of the reference current $I_{REFP}$ can be adjusted by trimming the current mirror ratio between the reference current $I_{REFP}$ and the current $I_B$. The trimming method is arbitrary. For example, as shown in FIG. 4B, the NMOS transistor $Q_{TC}$ includes n transistors $Q_{TC1}$ to $Q_{TCn}$ connected in parallel, and the switches SW1 to SWn are connected in series to these transistors. By switching on the selected switches SW1 to SWn, the selected transistors $Q_{TC1}$ to $Q_{TCn}$ are operated. That is, the sum of drain currents of the turned-on transistors becomes the reference current $I_{REFP}$. Each of the switches SW1 to SWn can be controlled by, for example, a controller of a semiconductor apparatus equipped with a constant current circuit.

The magnitude of the reference current $I_{REF}$ generated in the reference current generator 130 is the sum of the reference current $I_{REFP}$ flowing through the NMOS transistor $Q_{TC}$ and having the positive temperature coefficient and the reference current $I_{REFN}$ flowing through the resistor $R_{NP}$ and having the negative temperature coefficient. By appropriately trimming a ratio between the reference current $I_{REFP}$ having the positive temperature coefficient and the reference current $I_{REFN}$ having the negative temperature coefficient, a temperature coefficient of the reference current $I_{REF}$ can be adjusted to zero. An optimal ratio between the reference current $I_{REFP}$ and the reference current $I_{REFN}$ for achieving a zero temperature coefficient of the reference current $I_{REF}$ can be found by trimming a current under two or more different temperature conditions.

The output current generator 140 generates the output current $I_{MIRROR}$ to be supplied to the load based on the temperature-compensated reference current $I_{REF}$ generated by the reference current generator 130. For example, as shown in FIG. 3, the output current generator 140 includes the PMOS transistor Q2 that constitutes the current mirror with the PMOS transistor Q1 of the reference current generator 130, and generates the temperature-compensated output current $I_{MIRROR}$ based on the reference current $I_{REF}$. In addition, in one embodiment, another PMOS transistor Q3 is included between the PMOS transistor Q2 and the power supply voltage VDD, and a signal EN for enabling the output current generator 140 is applied to a gate of the PMOS transistor Q3. When the enable signal EN has been driven to a low level, the output current generator 140 supplies the output current $I_{MIRROR}$ to the load. In addition, the enable signal EN can be performed by, for example, a controller of a semiconductor apparatus equipped with a constant current circuit.

In the above embodiment, the temperature dependent current generator 120 generates, from the current $I_B$ of the BGR circuit 110, the current $I_B$ that is temperature dependent and has a positive temperature coefficient. However, the BGR circuit 110 is not necessarily used. That is, the temperature dependent current generator 120 may generate a temperature dependent current having a positive temperature coefficient independently of the BGR circuit 110, and supply the temperature dependent current to the reference current generator 130.

In addition, in the above embodiment, an example is shown in which the reference current generator 130 generates the reference current $I_{REF}$ having a temperature coefficient of zero. However, this is one example. For example, in the case of requiring a reference current having a positive temperature coefficient or a reference current having a negative temperature coefficient, the reference current generator 130 may also generate a temperature-compensated reference current $I_{REF}$ having a positive temperature coefficient or reference current $I_{REF}$ having a negative temperature coefficient by appropriately adjusting the ratio between the reference current $I_{REFP}$ having the positive temperature coefficient and the reference current $I_{REFN}$ having the negative temperature coefficient.

Although the embodiments of the disclosure have been described in detail, the disclosure is not limited to specific embodiments, and may be modified or altered within the scope of the gist of the disclosure as defined in the claims.

What is claimed is:

1. A constant current circuit, comprising:

a reference voltage generator, generating a reference voltage;

a reference current generator, generating a reference current that does not depend on a power supply voltage; and a temperature dependent current generator, generating a temperature dependent current having a positive temperature coefficient, wherein the reference current generator comprises a first circuit generating a first reference current having a negative temperature coefficient based on the reference voltage and a second circuit generating a second reference current having a positive temperature coefficient based on the temperature dependent current, and the reference current generator generates the reference current by adding up the first reference current having the negative temperature coefficient and the second reference current having the positive temperature coefficient, wherein the first circuit comprises a first operational amplifier comprising a non-inverting input terminal to which the reference voltage is input and an inverting input terminal in which an output node is short-circuited, the first operational amplifier is operating so as to generate an output voltage equal to the reference voltage at the output node and a resistor connected to a first path between the output node and ground, and the first reference current having the negative temperature coefficient is generated in the first path, the second circuit comprises a second path connected in parallel with the first path, and the second reference current having the positive temperature coefficient is generated in the second path, and the reference current is generated by adding up the first reference current having the negative temperature coefficient and flowing through the first path and the second reference current having the positive temperature coefficient and flowing through the second path, wherein the reference voltage generator comprises a bandgap reference circuit, the temperature dependent current generator is connected to the bandgap reference circuit, and the temperature dependent current generator generates the temperature dependent current based on a bandgap reference current for generating the reference voltage in the bandgap reference circuit, the bandgap reference circuit comprises a first current path and a second current path between the power supply voltage and the ground, the first current path comprises a first PMOS transistor, a first resistor and a first diode connected in series, the second current path comprises a second PMOS transistor, a second resistor, a third resistor and a second diode connected in series, the second PMOS transistor constitutes a current mirror circuit with the first PMOS transistor, the bandgap reference circuit further comprises a second operational amplifier comprising a non-inverting input terminal connected to a first node connecting the first resistor and the first diode, an inverting input terminal connected to a second node connecting the second resistor and the third resistor, and an output terminal is commonly connected to gates of the first PMOS transistor and the second PMOS transistor, the reference voltage is generated from a selected tap position of the second resistor.

2. The constant current circuit according to claim 1, wherein the second circuit comprises a first transistor of N-channel metal oxide semiconductor type generating the second reference current having the positive temperature coefficient in the second path.

3. The constant current circuit according to claim 2, wherein the first circuit comprises a first adjustment circuit adjusting a magnitude of the first reference current having the negative temperature coefficient.

4. The constant current circuit according to claim 3, wherein the first adjustment circuit adjusts a resistance value of the resistor on the first path.

5. The constant current circuit according to claim 3, wherein the second circuit comprises a second adjustment circuit adjusting a magnitude of the second reference current having the positive temperature coefficient.

6. The constant current circuit according to claim 5, wherein the second adjustment circuit adjusts a drain current flowing through the first transistor.

7. The constant current circuit according to claim 5, wherein the first adjustment circuit and the second adjustment circuit adjust the first reference current having the negative temperature coefficient and the second reference current having the positive temperature coefficient so that a temperature coefficient of the reference current becomes zero.

8. The constant current circuit according to claim 5, wherein the first adjustment circuit and the second adjustment circuit adjust the first reference current having the negative temperature coefficient and the second reference current having the positive temperature coefficient so that a temperature coefficient of the reference current becomes positive or negative.

9. The constant current circuit according to claim 2, wherein the temperature dependent current generator comprises a second transistor of N-channel metal oxide semiconductor type through which the temperature dependent current flows, and the first transistor and the second transistor constitute a current mirror circuit.

10. The constant current circuit according to claim 9, wherein the second circuit comprises a second adjustment circuit adjusting a mirror ratio of the current mirror circuit.

11. A semiconductor apparatus, comprising the constant current circuit according to claim 1.

* * * * *